US007284739B2

(12) United States Patent
Yasuki

(10) Patent No.: US 7,284,739 B2
(45) Date of Patent: Oct. 23, 2007

(54) STAND FOR ALBUMS, SCRAPBOOKS AND THE LIKE

(75) Inventor: Hideyuki Yasuki, Osaka (JP)

(73) Assignee: Nakabayashi Co., Ltd. (JP)

( * ) Notice: Subject to any disclaimer, the term of this patent is extended or adjusted under 35 U.S.C. 154(b) by 248 days.

(21) Appl. No.: 10/512,668

(22) PCT Filed: Apr. 17, 2003

(86) PCT No.: PCT/JP03/04926

§ 371 (c)(1),
(2), (4) Date: Oct. 26, 2004

(87) PCT Pub. No.: WO03/089249

PCT Pub. Date: Oct. 30, 2003

(65) Prior Publication Data

US 2005/0167562 A1 Aug. 4, 2005

(30) Foreign Application Priority Data

Apr. 19, 2002 (JP) ..... 2002-117904

(51) Int. Cl.
*A47G 1/24* (2006.01)

(52) U.S. Cl. ..... 248/457; 248/459; 281/33; 40/748; 40/753; 40/755

(58) Field of Classification Search ..... 248/457, 248/459; 281/33; 40/748, 753, 755
See application file for complete search history.

(56) References Cited

U.S. PATENT DOCUMENTS 527,694 A * 10/1894 Jones ..... 248/465
588,636 A * 8/1897 Engstrom ..... 248/465
2,419,823 A * 4/1947 Cross et al. ..... 40/753
2,480,918 A * 9/1949 Goldman ..... 40/754
2,614,353 A * 10/1952 Goldman ..... 40/750
2,798,322 A * 7/1957 Nichols ..... 40/120
3,785,605 A * 1/1974 Parekh ..... 248/455
4,240,761 A * 12/1980 Jacobson ..... 402/76
4,291,798 A * 9/1981 Transport ..... 206/45.24
4,609,206 A * 9/1986 O'Brien ..... 281/33
5,975,578 A * 11/1999 Mayer ..... 281/37
6,557,897 B1 * 5/2003 Gaudet ..... 281/33

FOREIGN PATENT DOCUMENTS

JP S29-16820 12/1954
JP S30-12111 8/1955
JP S47-2322 1/1972
JP S51-1858 1/1976

(Continued)

*Primary Examiner*—Carl D. Friedman
*Assistant Examiner*—Michael McDuffie
(74) *Attorney, Agent, or Firm*—Thompson Hine LLP

(57) ABSTRACT

The present invention provides a stand for albums, scrapbooks and the like which is simple and compact causing no trouble to a user. Means for fixing an attaching portion of a stand capable to bend through a fold line to a back cover of an album, a scrapbook or the like and connecting the back cover and the support leg with a strip to adjust a bending angle of the support leg are adapted. Means for providing one end of a strip between a core material and a cloth material at a bottom line of a support leg and providing another end of the strip between a core material and an end paper at a bottom border of a back cover are applied.

4 Claims, 6 Drawing Sheets

FOREIGN PATENT DOCUMENTS

| | | |
|---|---|---|
| JP | S57-34477 | 2/1982 |
| JP | S58-12464 | 1/1983 |
| JP | S59-14218 | 4/1984 |
| JP | S59-38304 | 10/1984 |
| JP | S61-200264 | 12/1986 |
| JP | H1-156973 | 10/1989 |
| JP | H4-31879 | 5/1992 |
| WO | WO 98/13215 | 4/1998 |

* cited by examiner

STAND FOR ALBUMS, SCRAPBOOKS AND THE LIKE

This application claims priority from Japanese Patent Application No. 2002-117904 filed on Apr. 19, 2002, the entire contents of which are incorporated herein by reference.

BACKGROUND OF THE INVENTION

1. Field of the Invention

This invention relates to a stand structure which enables an album, a scrapbook and the like to be self-sustaining and be decoration such as a photo stand by attaching a support leg to a back of the album, the scrapbook and the like.

2. Description of the Related Art

There have been already articles such as an album, a photo mount and a file, to which a stand is attached for a purpose to display a photograph decoratively as an alternative to a conventional photo stand. For example, an album disclosed in Japanese Utility Model Open Gazette No. S59-14218 is composed of a mount and a cover shielding front and back surfaces of the mount around. In this album, a triangular stand is to be formed by folding suitable parts of the cover. However, the cover of the album is hard chartaceous and therefore becomes unstable when placed on an uneven ground contacting surface such as a laced mat. This problem arises from a fact that a stand contacts a ground on a plane. Accordingly, a preferred placing way is to let a stand up on a line or a point. Further, each support leg disclosed in a photo box and an account book in Japanese Open Gazette for Utility Model No. S57-34477 and Japanese Utility Model Gazette No. S 30-12111 respectively has a similar structure and naturally has the same problem. In addition, these two inventions are inconvenient to carry or store, for the support leg thereof become bulky when folded down.

On the other hand, a stand for a pocket album in Japanese Patent Gazette No. H4-31879 and an album with a stand in Japanese Open Gazette for Utility Model No. S61-200264 are both not handy for a user since the stand thereof has to be put together by the user.

A stand structure as explained above has not been suggested so far as to an album that is comprised of conventional front and back covers and binder inserts, or a scrapbook.

SUMMARY OF THE INVENTION

In light of this situation, the present invention discloses a stable stand for albums, scrapbooks and the like, a structure of which is simple and compact causing no trouble to a user. Albums, scrapbooks and the like mentioned in this specification should not be limited to those comprised of front and back covers and binder inserts but broadly include books, picture books, photo collections and booklets which are bound or bound temporarily like a file.

To solve the above problem, this invention utilizes a stand composed of a support leg capable to bend through a fold line, and an attaching portion. In the claim 1, means for fixing the attaching portion of the stand to a back cover of an album, a scrapbook and the like and connecting the support leg with the back cover by way of a strip to adjust a bending angle of the support leg are adapted. A back cover of an album, a scrapbook and the like has a double-structure and an outer side of the double-structured back cover has two slits therein from a bottom border to a middle point. A portion made by the two slits is to be a support leg by standing thereof through a fold line and a bending angle of the support leg is adjusted with a strip which connects the back cover and the support leg. This invention further provides a double-structured back cover, a half bottom of which is to be a support leg by standing thereof through a fold line and a bending angle of the support leg is adjusted with a strip which connects the back cover and the support leg. The above structure enables a support leg to support an album and the like for being self-sustaining and in this case, a strip may keep the support leg stood at a certain angle.

In a stand of this invention, a strip connects a back cover and a support leg at bottom borders of the back cover and the support leg. One end of strip is bonded between a core material and a cloth material at a bottom border of a support leg and another end of the strip is bonded between a core material and an end paper at a bottom border of a back cover. Adequate strength against tensile put on the strip can be gained by running the strip between the bottom borders of the back cover and the support leg, particularly by stretching the strip as if reeling the core material.

As further means, a width of a strip is equalized with a width of a bottom line of a support leg. A number of strips may be allowed as plural. Adequate strength can be gained through broadening a width of a strip or providing plural number of strips, for tensile put on a strip is to be dispersed.

DESCRIPTION OF THE PREFERRED EMBODIMENTS

Figure 1:
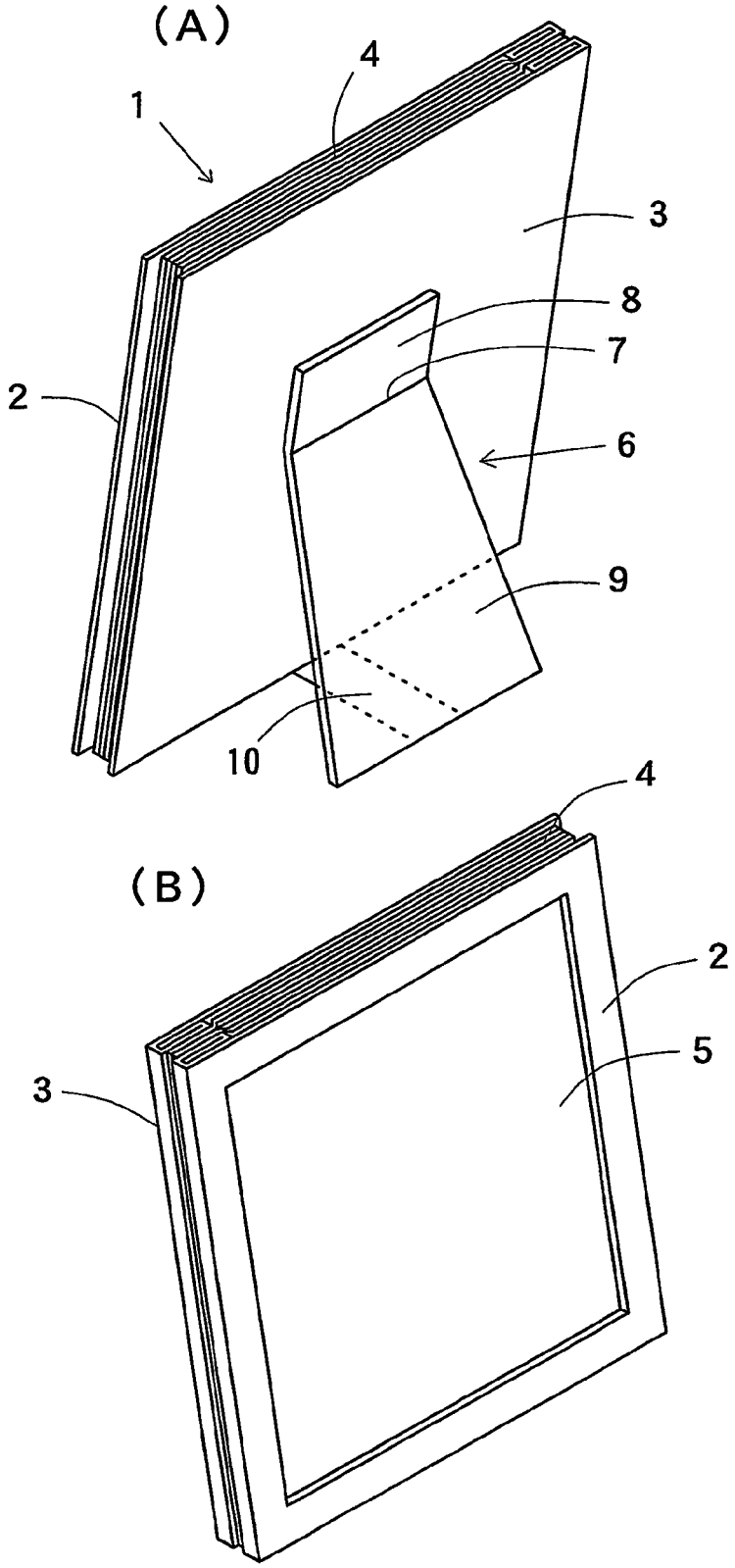
FIG. 1 is a perspective view showing one embodiment of a stand structure in the present invention applied to a scrapbook.

Hereafter, preferred embodiments of a stand for albums, scrapbooks, and the like in the present invention are discussed referring to the drawings. FIGS. 1 (A) and (B) are perspective view showing an example that a stand structure in the present invention is applied to a scrapbook. In this figure, 1 is a scrapbook, wherein a discretionary number of binder inserts 4 are bound between a front cover 2 and a back cover 3. A store portion 5 having a display window is provided within the front cover 2. The front cover 2 may be decorated with the store portion 5 by placing a sheet (a binder insert) with a photograph and/or a picture and so forth into the store portion 5. This type of scrapbook has been disclosed in our Japanese Patent Application No. 2000-205517 (U.S. patent application Ser. No. 09/898,120). A binder insert used in this scrapbook is made by placing a sheet, to which a photograph or a pamphlet and so forth having a sheet form may be attached or a picture and/or an illustration and so forth may be drawn, into a transparent resin pocket (a protector). While binding a plurality of binder inserts 4 between the front cover 2 and the back cover 3, a favored binder insert 4 can be displayed by placing in the store portion 5 within the front cover 2. Accordingly, when self-support of this scrapbook is realized, the scrapbook can be used as a decoration of a desk like a conventional photo stand.

6 is a stand fixed on the back cover 3 of the scrapbook 1. A shape of the stand is almost trapezoid and the stand is divided into two parts, an attaching portion 8 and a support leg 9 through a fold line 7. The support leg 9 may be bended downwards through the fold line 7 optionally. 10 is a strip connected between borders of the support leg 9 and the back cover 3 for adjusting a bending angle of the support leg 9.

A pliable material is preferable for the strip 10 such as cloth, non-textile, a paper, a thread, a resin film, for pliability and bendability of the material will absorb unevenness of a place keeping the support leg 9 at a required bending angle for the scrapbook 1 to stand still stably. In light of strength of a material or a sense of beauty, a width of the strip 10 may be suitably decided by selecting from a thread type to a wide type having the same width with a bottom border of the support leg 9. The number of strips may be also decided optionally.

Figure 2:
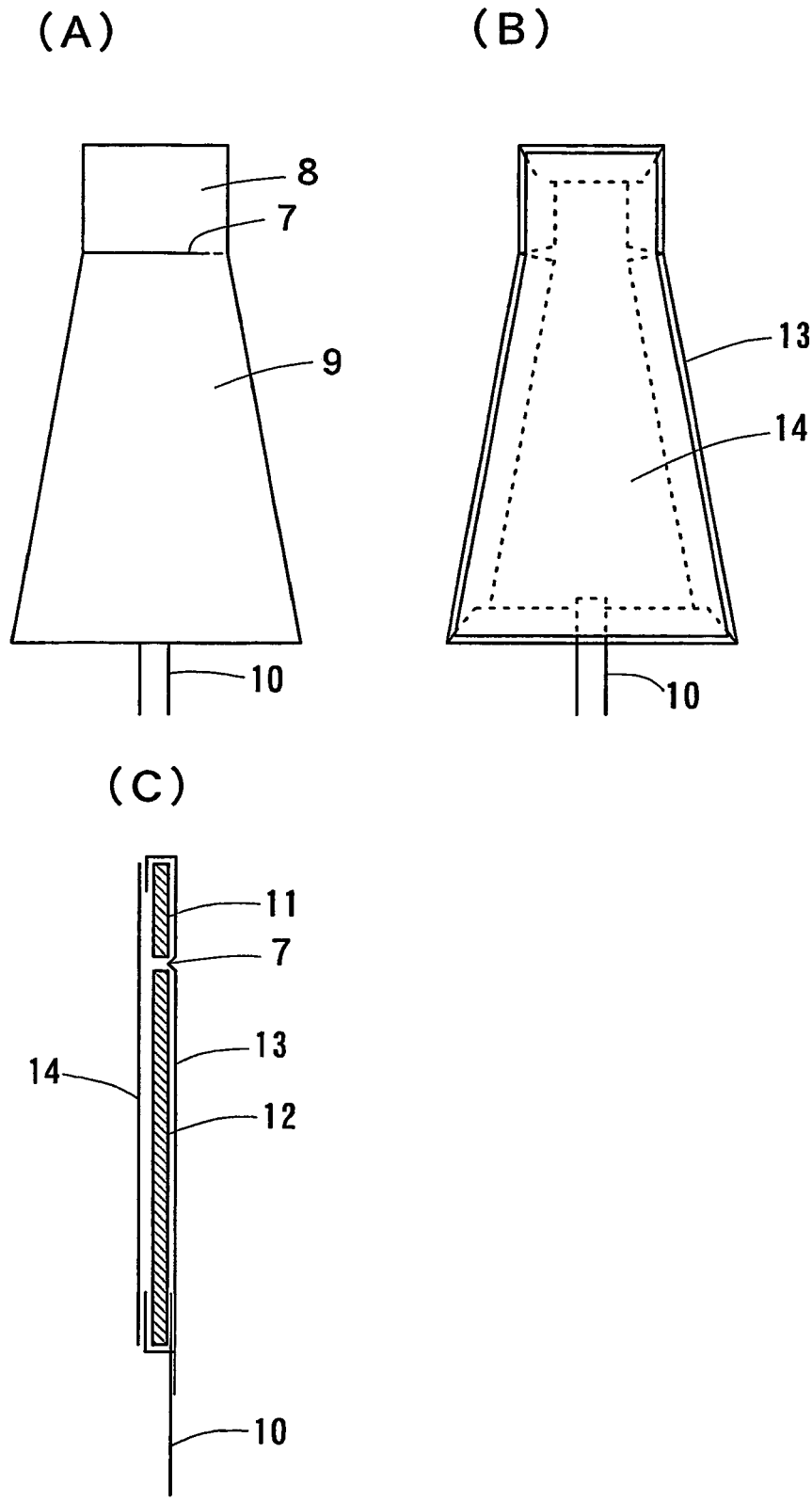
FIG. 2 shows a front side, a back side and a partly omitted sectional view of a stand.

Hereafter, a concrete structure of the stand 6, particularly a fixing condition of a strip is discussed. FIG. 2 (A) shows a front side, (B) shows a back side and (C) is an outlined perspective view of the stand. In this figure, 11 is a core material for the attaching portion 8 and 12 is a core material for the support leg 9. Both of the core materials are composed of a cardboard and so forth. 13 is a cloth material which is composed of paper or cloth and preferably the same material with the front and back cover of the scrapbook. 14 is an end paper. As obvious from the FIG. 2 (C), each core material 11 and 12 is covered with the cloth material 13 leaving a space therebetween for the fold line 7. Further, the end paper 14 is pasted on to the cloth material 13 as folded back to a back side. The above core material may be seriate and a fold line portion can be bendable by creating a line with pressure by a press. In this case, it is essential that an end of the strip 10 is fixed as if reeling between the core material 12 and the cloth material 13. With the above fixing way, the strip can withstand tensile put thereon.

In other words, the strip 10 has a function to keep a regular interval between contacting points of the back cover 3 and the support leg 9 when the stand is opened. Since the scrapbook 1 itself is rather heavy, a considerable tensile will be put on the strip 10. Accordingly, as shown in FIG. 3 (A), if the strip is provided between the back cover 3 and the support leg 9 simply by attaching to opposite surfaces of the back cover 3 and the support leg 9, an attached portion of the strip 10 may be likely to be peeled off by this tensile.

Figure 4:
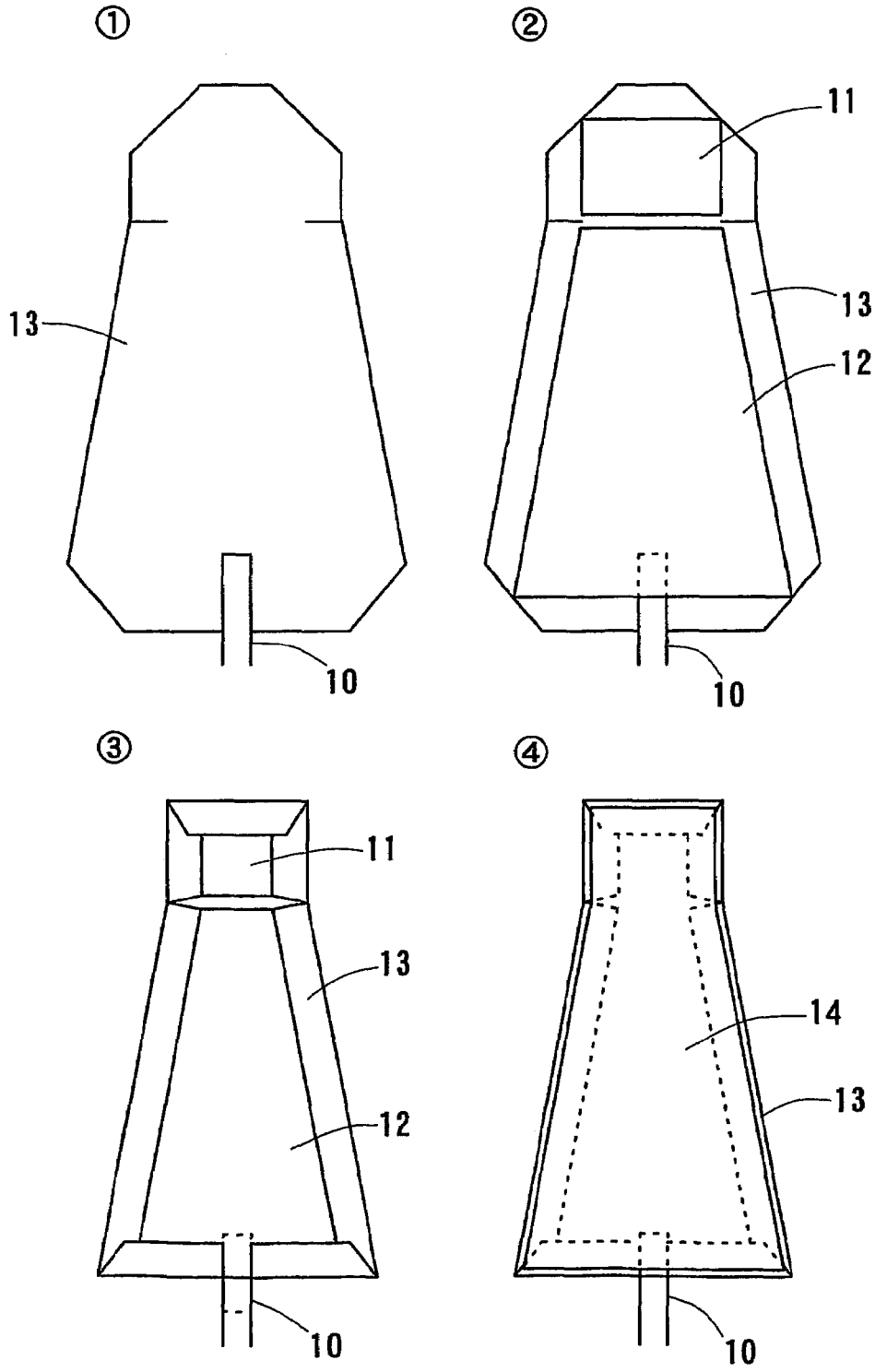
FIG. 4 shows a process of fixing a strip to a stand.

FIG. 4 shows one example of manufacturing process of the stand 6. Process 1 illustrates a process of spreading adhesive all over a back surface of the cloth material 13 and fixing an end of the strip at a bottom part. Process 2 illustrates a process of attaching each core materials 11 and 12 to suitable places. Process 3 illustrates a process of folding back each end portions of the cloth material 13 to a back side and pasting thereof. And process 4 illustrates a process of pasting the end paper 14 to the whole back side to arrange an appearance. With the above processes, a strip can be fixed firmly enough to withstand tensile.

Figure 5:
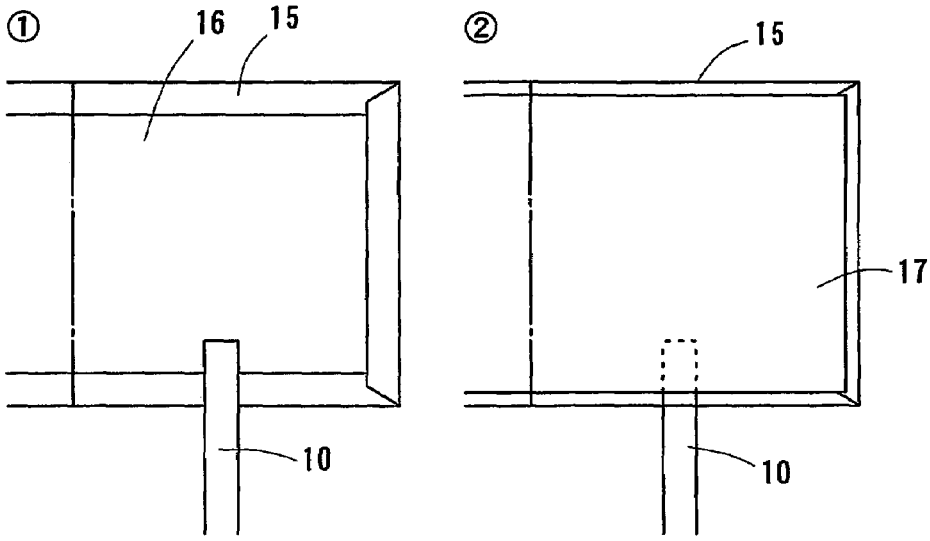
FIG. 5 shows a process of fixing a strip to a back cover.

The above process can be applied to a case of fixing the strip 10 to the back cover 3. To be precise, as shown in FIG. 5, process 1 illustrates a process of attaching a core material 16 to a cloth material 15, folding back an end of the cloth material 15 and fixing an end of the strip 10 to a bottom portion. Process 2 illustrates a process of pasting an end paper 17 to cover a whole back side.

Figure 3:
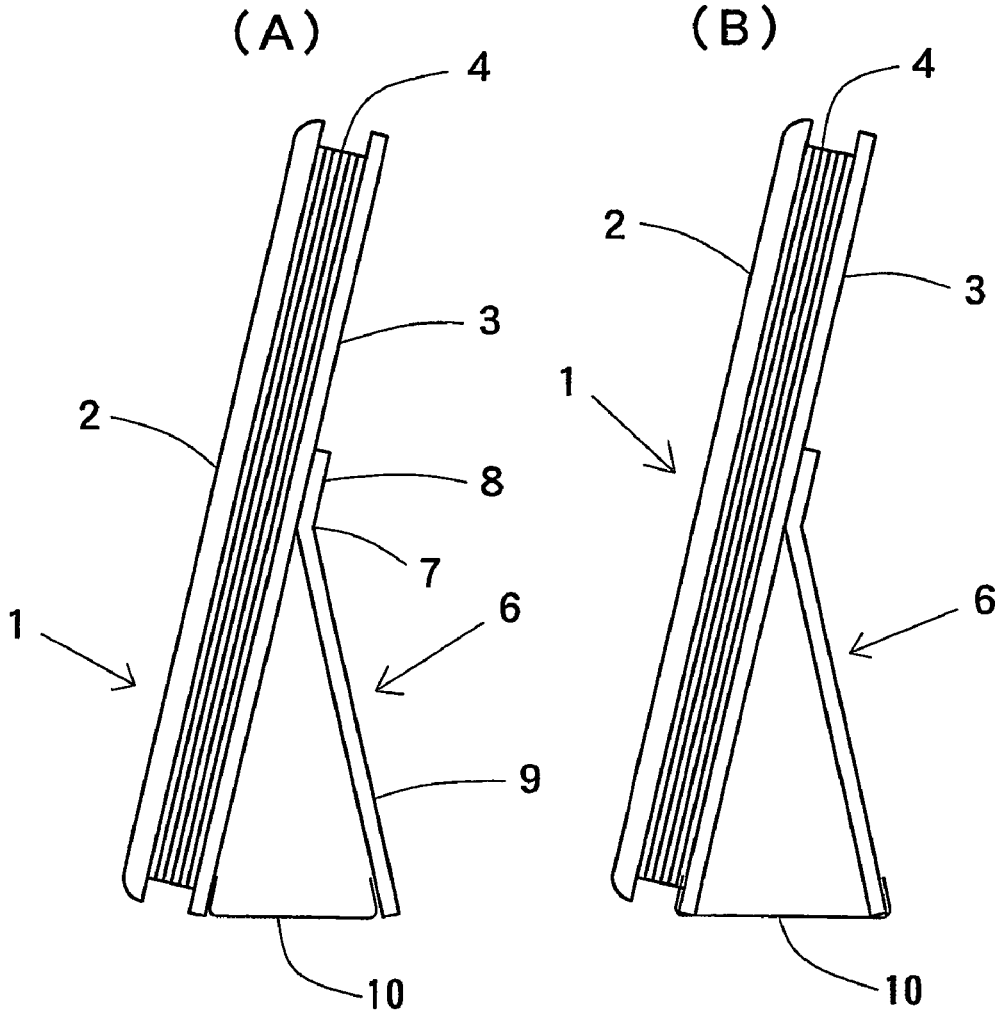
FIG. 3 is side elevational view comparing fixing method of a strip.

Providing the strip 10 as explained above enables the strip 10 to be able to adequately withstand tensile applied when the stand opens, for the strip 10 as shown in FIG. 3 (B) is run as if reeling each core materials. Further, even if a strip is provided as explained, the strip will not become an obstacle when closing the stand, for the strip is composed of a pliable thin material.

Figure 6:
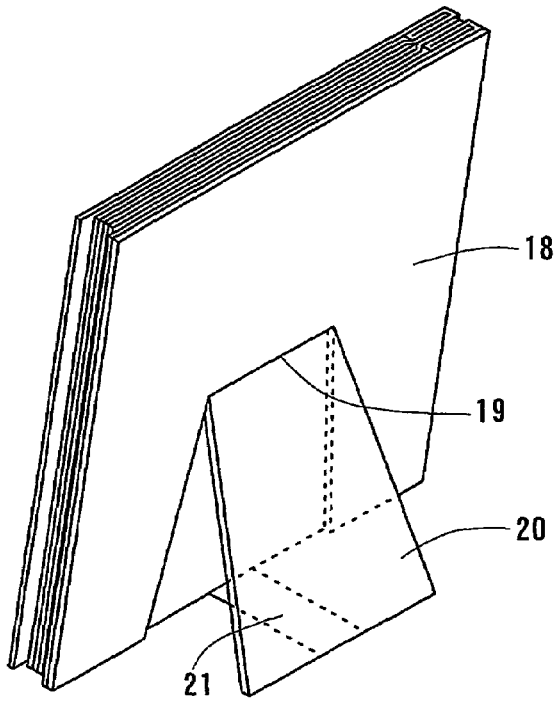
FIG. 6 is a perspective view showing the second embodiment of a stand structure in the present invention.

FIG. 6 shows another preferable embodiment of a stand structure. In this figure, 18 is a back cover having a double-structure of a scrapbook. Two slits are provided within only an outer cover from a bottom line to a middle point and a portion made by the two slits is to be a support leg 20 by standing thereof through a fold line 19. A strip 21 is provided between bottom lines of the support leg 20 and the back cover 18 to adjust a bending angle of the support leg 20. As to the strip 21, the same material and attaching condition with the aforesaid strip are applied. According to this structure, the scrapbook can be self-sustaining and used as decoration by standing the stand 20 up. Further, if the support leg 20 is folded down, the back cover 18 becomes flat, which is convenient to store in a shelf or carry around.

Figure 7:
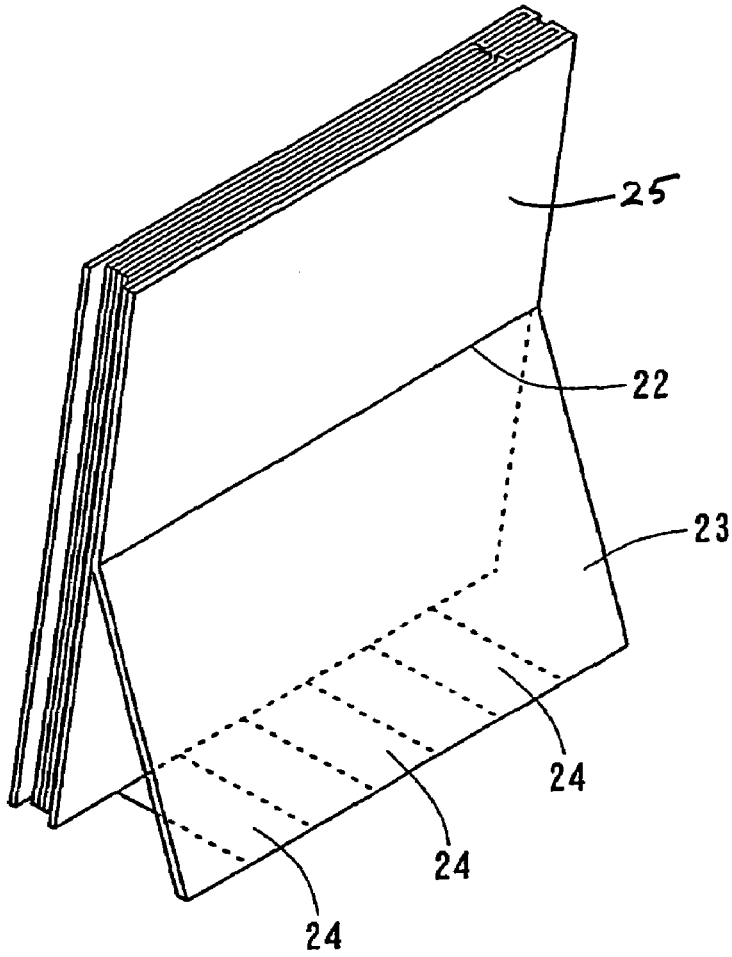
FIG. 7 is a perspective view showing the third embodiment of a stand structure in the present invention.

FIG. 7 shows another embodiment of a stand structure, wherein a back cover 25 of a scrapbook has a double-structure and a half bottom of an outer side of the back cover 25 is to be a support leg 23 through a fold line 22. Further, a plurality of strips 24 are provided between an inner side of the back cover 25 and the support leg 23 to adjust a bending angle of the support leg 23. This structure also enables the scrapbook to become self-sustaining by standing the support leg 23 up and be convenient to store by folding down the support leg 23. In addition, a strength will be increased as plural strips diffuse tensile.

The aforesaid embodiments take a scrapbook having a display window within a front cover as an example but should not be limited to scrapbooks. In other words, conventional albums have elaborately designed front covers and some thereof can be used as decoration by printing a photograph or a picture. Applying a stand structure in the present invention allows these albums to be a photo stand for use as decoration. The same effect will be obtained on picture books and/or photo collections since those books also have elaborately designed front covers. Accordingly, a stand structure in the present invention can be practical to a wide range of books, files and the like.

As described above, a stand structure of albums, scrapbooks and the like in the present invention is an excellent invention capable of being an interior decoration with a stand attached to a back surface of the albums, scrapbooks and the like to be self-sustaining. Since a structure is markedly simple and not bulky, an album can be easily put away and meantime, quickly function as a stand if necessary.

A stable stand structure is obtained owing to a particular way of fixing by which a strip reels core materials of a support leg and a back cover enabling adequately to withhold tensile put on the strip when an album is self-sustaining as a stand. Further, a strip is flexible and pliable enabling an album to be placed stably even on an uneven surface.

The invention claimed is:

1. A self-sustaining display device comprising:

a book having a back cover and a front cover;

a support leg provided to a middle portion in an outer side of said back cover and capable to bend through said middle portion; and a strip composed of a pliable material and connected between bottom borders of said support leg and said back cover for adjusting a bending angle of said support leg, wherein said support leg comprises a first core material and a cloth material covering said first core material, said back cover comprises a second core material and an end paper attached to said second core material, one end of said strip is provided between said first core material and said cloth material at a bottom border of said support leg and another end is provided between said second core material and said end paper at a bottom border of said back cover.

2. The self-sustaining display device of claim 1, wherein said book is at least one of an album, a scrapbook, a picture book, a photo collection and a booklet.

3. The self-sustaining display device of claim 1, wherein said back cover has a double-structure and said support leg is made by two slits provided from a bottom border to a middle portion in an outer side of said double-structure.

4. The self-sustaining display device of claim 1, wherein said back cover has a double-structure and said support leg is made by a half bottom of an outer side of said double-structure.

* * * * *